US009195163B2

(12) United States Patent
Hamaguchi et al.

(10) Patent No.: US 9,195,163 B2
(45) Date of Patent: Nov. 24, 2015

(54) DEVELOPING DEVICE AND IMAGE FORMING APPARATUS INCORPORATING SAME

(71) Applicants: Masaya Hamaguchi, Kanagawa (JP); Hitoshi Nakamura, Kanagawa (JP)

(72) Inventors: Masaya Hamaguchi, Kanagawa (JP); Hitoshi Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/190,631

(22) Filed: Feb. 26, 2014

(65) Prior Publication Data

US 2014/0255062 A1 Sep. 11, 2014

(30) Foreign Application Priority Data

Mar. 11, 2013 (JP) ..... 2013-047863

(51) Int. Cl.
*G03G 15/08* (2006.01)
*G03G 15/09* (2006.01)
*G03G 15/06* (2006.01)

(52) U.S. Cl.
CPC ..... *G03G 15/065* (2013.01)

(58) Field of Classification Search
CPC ..... G03G 15/065
USPC ..... 399/285, 270
See application file for complete search history.

(56) References Cited

U.S. PATENT DOCUMENTS

| | | | | |
|---|---|---|---|---|
| 6,266,508 | B1 * | 7/2001 | Nakagawa et al. | 399/285 |
| 2004/0067071 | A1 * | 4/2004 | Hibino | 399/55 |
| 2005/0063721 | A1 * | 3/2005 | Nakayama et al. | 399/49 |
| 2006/0142470 | A1 * | 6/2006 | Sato et al. | 524/556 |
| 2008/0145077 | A1 * | 6/2008 | Hamada | 399/56 |
| 2009/0232561 | A1 * | 9/2009 | Lean et al. | 399/266 |
| 2012/0107739 | A1 * | 5/2012 | Yamashita et al. | 430/119.82 |
| 2012/0134722 | A1 * | 5/2012 | Sasaki et al. | 399/269 |
| 2013/0078008 | A1 * | 3/2013 | Mizumoto et al. | 399/285 |

FOREIGN PATENT DOCUMENTS

| | | |
|---|---|---|
| JP | 61-054879 | 3/1986 |
| JP | 2000-347507 | 12/2000 |
| JP | 2001-242711 | 9/2001 |
| JP | 2002-091186 | 3/2002 |
| JP | 2003-287961 | 10/2003 |
| JP | 2008-287243 | 11/2008 |

* cited by examiner

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

A developing device includes a developer bearer disposed facing a latent image bearer in a development range, and an alternating voltage application unit to apply alternating voltage to the developer bearer to generate an alternating electrical field in the development range to cause toner to move from the developer bearer to the latent image bearer while reciprocating therebetween. The alternating voltage has a frequency within a range from 20 kHz to 60 kHz and a peak-to-peak voltage equal to or greater than 300 V.

9 Claims, 13 Drawing Sheets

ALTERNATING VOLTAGE (2 KHz)

ALTERNATING VOLTAGE (9 KHz)

ALTERNATING VOLTAGE (10 KHz)

ALTERNATING VOLTAGE (20 KHz)

ALTERNATING VOLTAGE (40 KHz)

ALTERNATING VOLTAGE (60 KHz)

ALTERNATING VOLTAGE (70 KHz)

ALTERNATING VOLTAGE (80 KHz)

ALTERNATING VOLTAGE (100 KHz)

DEVELOPING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2013-047863, filed on Mar. 11, 2013, in the Japan Patent Office, the entire disclosure of which is hereby incorporated by reference herein.

BACKGROUND OF THE INVENTION

1. Technical Field

The present invention generally relates to a developing device to develop images by generating an alternating electrical field in a development range and further relates to an image forming apparatus, such as, a copier, a printer, a facsimile machine, a plotter, or a multifunction peripheral (MFP) having at least two of coping, printing, facsimile transmission, plotting, and scanning capabilities, that includes the developing device.

2. Description of the Background Art

In electrophotographic image forming apparatuses, such as copiers and printers, after being uniformly charged, the surface of a latent image bearer is exposed with light, thereby forming an electrostatic latent image thereon. The electrostatic latent image is then developed into a toner image. The toner image is transferred onto a sheet of recording media either directly or via an intermediate transfer member.

Various development types have been proposed so far. Specifically, there are direct voltage development and alternating voltage development, and differences in properties of developer exhibited in direct voltage application and alternating voltage application respectively are used to attain high image quality. Additionally, there are multiple developer types, namely, one-component developer and two-component developer, and development type further depends on the transfer type of developer to the latent image bearer in the development range, either direct contact or contactless. Yet additionally, distinctive latent image bearers and distinctive developer bearers have been developed, and new development methods using them are proposed to fulfill performance of the image forming apparatus with the combination of developer properties and the development methods. In particular, the following approaches in alternating voltage development have been proposed.

For example, JP-2003-287961-A proposes an image forming apparatus in which, while merits of alternating voltage development are maintained by increasing a frequency f and a peak-to-peak voltage Vpp of alternating voltage used as development bias, demerits such as image disturbance and scattering of two-component developer to a photoreceptor drum are inhibited. It is proposed that, in this image forming apparatus, the frequency of the alternating voltage applied to a developing sleeve is within a range from 4 kHz to 7 kHz, and the peak-to-peak voltage of the alternating voltage is within a range from 1.5 kV to 2.5 kV.

Additionally, JP-2000-347507-A proposes an image forming apparatus designed aiming at suppressing background stains and the occurrence of absence of toner at the rear end of a recording medium (hereinafter "rear-end void"). Specifically, in this image forming apparatus, development bias has a frequency f within a range from 5 kHz to 15 kHz, and the amplitude Vpp (kV) of the alternating component of the development bias is reduced cyclically. JP-2000-347507-A discloses evaluation results regarding background stains, rear-end void, and granularity in an experiment for effect confirmation in which the frequency f of the alternating component of the development bias is varied within a range from 0 to 20 kHz.

According to the disclosed results, background stains are inhibited as the frequency f increases toward 20 kHz. Rear-end void and granularity, however, worsen as the frequency f increases toward 20 kHz.

SUMMARY OF THE INVENTION

In view of the foregoing, one embodiment of the present invention provides a developing device that includes a developer bearer disposed facing a latent image bearer in a development range, and an alternating voltage application unit to apply alternating voltage to the developer bearer to generate an alternating electrical field in the development range. With the alternating electrical field, toner moves from the developer bearer to the latent image bearer while reciprocating therebetween. The alternating voltage has a frequency within a range from 20 kHz to 60 kHz and a peak-to-peak voltage equal to or greater than 300 V.

In another embodiment, a developing device includes the developer bearer and the alternating voltage application unit described above, and the alternating voltage has a frequency within a range from 10 kHz to 60 kHz and a peak-to-peak voltage of 300 V or greater. The alternating voltage has a waveform including a development portion having a polarity to move toner from the developer bearer to the latent image bearer and a non-developing portion having a polarity opposite the polarity of the development portion, and a leading end portion is greater in absolute voltage value than the rest in at least one of the development portion and the non-development portion.

In yet another embodiment, an image forming apparatus includes the latent image bearer, a latent image forming unit to form a latent image on the latent image bearer, and either of the above-described developing devices.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
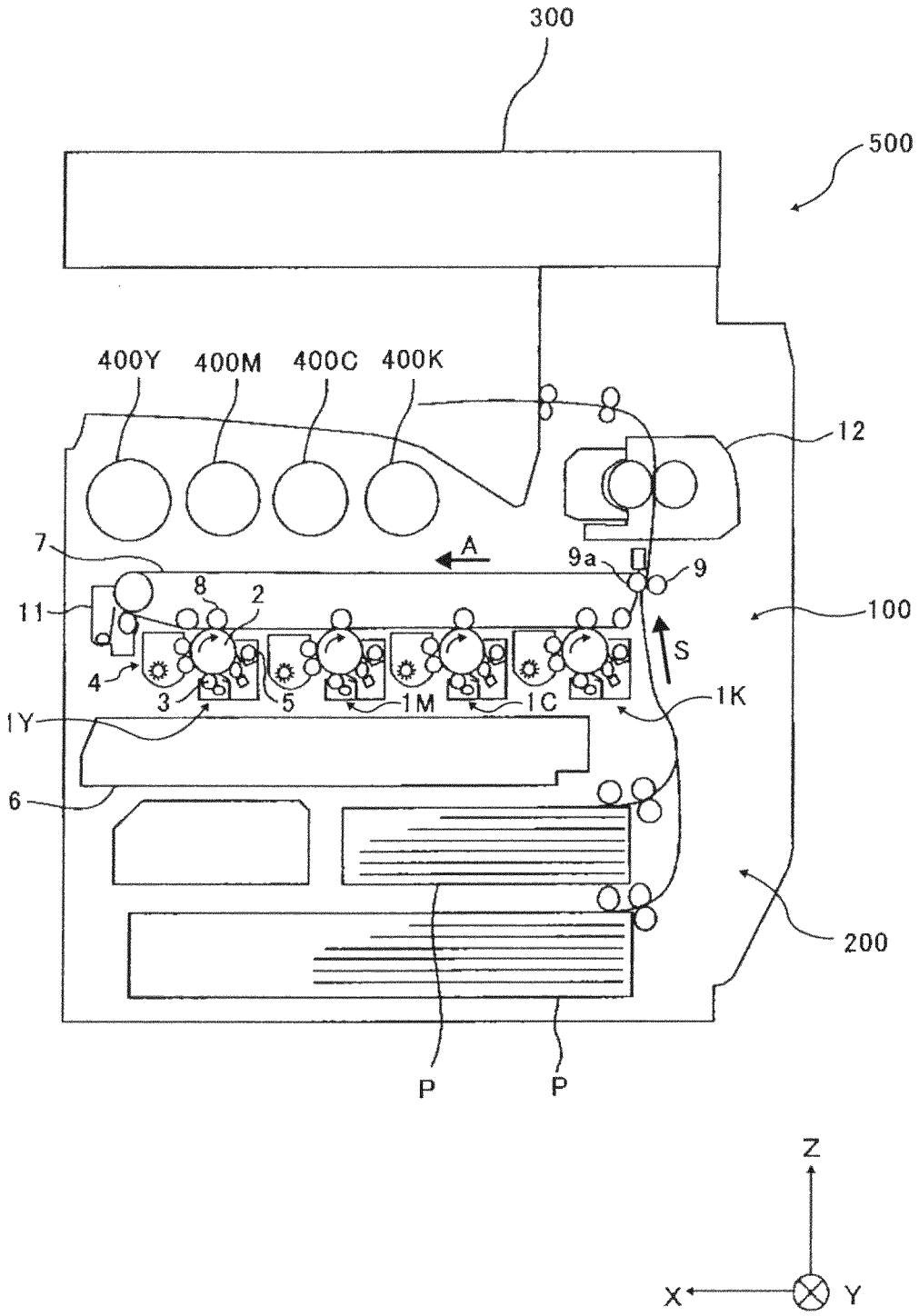
FIG. 1 is a schematic diagram that illustrates a configuration of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The inventors of the present invention become aware of degradation of edge reproducibility while working on image quality improvement in alternating voltage development. The term "degradation of edge reproducibility" used in this specification means that toner is partly absent at edges of a latent image adjacent to a non-image area (i.e., background), and thus edges of a resultant image are not fully reproduced.

The inventors of the present invention have found that a major contributor of degradation of edge reproducibility is a phenomenon called "scavenging" and removal of toner that occur while toner reciprocates in the development range in which an alternating electrical field is generated and recognize that the occurrence of scavenging significantly depends on the reciprocation amplitude of toner.

The term "scavenging" means a phenomenon in which toner once adhering to the latent image returns to the developer bearer.

In view of the foregoing, an aim of the present invention is to provide a developing device capable of alleviating degradation of edge reproducibility in alternating voltage development in which toner reciprocates in the development range and an image forming apparatus incorporating the developing device.

Scavenging is described below.

In alternating voltage development, toner in the development range reciprocates between the latent image bearer and the developer bearer (two-component developer reciprocates between the latent image bearer and carrier) since development fields (i.e., development electrical fields) to move toner from the developer bearer to the latent image bearer and non-development fields (i.e., non-development electrical fields) to return developer from the latent image bearer to the developer bearer are formed alternately in the development range. Toward the exit of the development range, the distance between the latent image bearer and the developer bearer (carrier in the case of two-component developer, which is similar in the description below) increases gradually, and the strength of electrical fields decreases accordingly. In this area, the strength of development fields is set greater than that of non-development fields since it is preferred that a major part of toner be transferred onto the latent image formed on the latent image bearer. Accordingly, adjacent to the exit of the development range, toner in the non-development field does not move to the developer bearer, but toner in the development field can move to the latent image bearer. As a result, the latent image bearer exits the development range with a sufficient amount of toner adhering to the latent image formed thereon.

If the reciprocation amplitude of toner in the development range is extremely large, however, it is possible that toner adhering to the latent image bearer adjacent to the exit of the development range returns to the developer bearer even if the distance between the latent image bearer and the developer bearer is increased to a certain degree. Even when the development field again acts on the returning toner on the developer bearer, transferring toner again to the latent image bearer fails with high probability since the distance between the latent image bearer and the developer bearer increases further.

Moreover, the amplitude of the reciprocation of toner in the development range increases as the frequency of the alternating voltage is lowered. Accordingly, when the reciprocation amplitude of toner is large, it can be deemed that the frequency of the alternating voltage is relatively low. As the frequency of development voltage applied to the developer bearer becomes lower, the time during which the non-development field is generated increases, and it takes longer for a subsequent development field to act on the returning toner on the developer bearer. Thus, in a case in which the reciprocation amplitude of toner is large, after toner is returned by the non-development field to the developer bearer adjacent to the exit of the development range, it takes longer for the development field to act again on the returning toner. When the development field acts on the returning toner, it is likely that the distance between the latent image bearer and the developer bearer is too large to transfer toner again to the latent image bearer. From the above-described causes, it can be said that scavenging is likely to occur when the reciprocation amplitude of toner in the development range is large. Since adverse effects of scavenging are significant in edge reproducibility, edge reproducibility is degraded in alternating voltage development.

It can be assumed that reducing the reciprocation amplitude of toner is effective in suppressing the occurrence of scavenging and alleviating the degradation of edge reproducibility. Although the peak-to-peak voltage of the alternating voltage is typically reduced to reduce the reciprocation amplitude of toner, it is not preferable since reduction in the peak-to-peak voltage of alternating voltage adversely affects various merits obtained by alternating voltage development. Meanwhile, the reciprocation amplitude of toner in the development range largely depends on the frequency of the alternating voltage as well.

In view of the foregoing, in the embodiment described below, the reciprocation amplitude of toner is reduced by increasing the frequency of the alternating voltage.

Conventionally, it is known that the frequency of the alternating voltage applied to the developer bearer is preferably as high as about 15 kHz to attain the merits of alternating voltage development, and it is considered that no merits arise when the frequency is higher than that. The inventors of the present invention pay attention to a frequency range including the conventional upper limit of 15 kHz and higher values to alleviate degradation of edge reproducibility inherent to alternating voltage development.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic diagram that illustrates a configuration of an image forming apparatus 500 according to the present embodiment.

The image forming apparatus 500 includes an apparatus body 100 (or printer unit), a sheet-feeding table or sheet feeder 200, and a scanner 300 provided above the apparatus body 100.

The apparatus body 100 includes four process cartridges 1Y, 1M, 1C, and 1K, an intermediate transfer belt 7 serving as an intermediate transfer member that rotates in the direction indicated by arrow A shown in FIG. 1 (hereinafter "belt travel direction"), an exposure device 6, and a fixing device 12.

It is to be noted that the suffixes Y, M, C, and K attached to each reference numeral indicate only that components indicated thereby are used for forming yellow, magenta, cyan, and black images, respectively. The four process cartridges 1 have a similar configuration except the color of toner used therein, and hereinafter the suffixes Y, M, C, and K may be omitted when color discrimination is not necessary.

Each process cartridge 1 includes a photoreceptor 2, a charging member 3, a developing device 4, and a drum cleaning unit 5, and these components are housed in a common unit casing, thus forming a modular unit. The process cartridge 1 can be installed in the apparatus body 100 and removed therefrom by releasing a stopper.

The photoreceptor 2 rotates clockwise in the drawing as indicated by arrow shown therein. The charging member 3 can be a charging roller. The charging member 3 is pressed against the surface of the photoreceptor 2 and rotates as the photoreceptor 2 rotates. In image formation, a high-voltage power source applies a predetermined bias voltage to the charging member 3 so that the charging member 3 can electrically charge the surface of the photoreceptor 2 uniformly. Although the process cartridge 1 according to the present embodiment includes the charging member 3 that contacts the surface of the photoreceptor 2, alternatively, contactless charging members such as corona charging members may be used instead.

The exposure device 6, serving as a latent image forming unit, exposes the surface of the photoreceptor 2 according to image data read by the scanner 300 or acquired by external devices such as computers, thereby forming an electrostatic latent image thereon. Although the exposure device 6 in the configuration shown in FIG. 1 employs a laser beam scanning method using a laser diode, other configurations such as those using light-emitting diode (LED) arrays may be used. The drum cleaning unit 5 removes toner remaining on the photoreceptor 2 after the photoreceptor 2 passes by a position facing the intermediate transfer belt 7.

The four process cartridges 1 form yellow, cyan, magenta, and black toner images on the respective photoreceptors 2. The four process cartridges 1 are arranged parallel to each other in the belt travel direction indicated by arrow A. The toner images formed on the respective photoreceptors 2 are transferred therefrom and superimposed sequentially one on another on the intermediate transfer belt 7 (primary-transfer process). Thus, a multicolor toner image is formed on the intermediate transfer belt 7.

In FIG. 1, primary-transfer rollers 8 serving as primary-transfer members are provided at positions facing the respective photoreceptors 2 via the intermediate transfer belt 7. Receiving a primary-transfer bias from a high-voltage power source, the primary-transfer roller 8 generates a primary-transfer electrical field between the photoreceptor 2 and the primary-transfer roller 8. With the primary-transfer electrical field, the toner images are transferred from the respective photoreceptors 2 onto the intermediate transfer belt 7. As one of multiple tension rollers around which the intermediate transfer belt 7 is looped is rotated by a driving roller, the intermediate transfer belt 7 rotates in the belt travel direction indicated by arrow A shown in the drawing. While the toner images are superimposed sequentially on the rotating intermediate transfer belt 7, the multicolor toner image is formed thereon.

Among the multiple tension rollers, a secondary-transfer facing roller 9*a* is disposed downstream from the four process cartridges 1 in the belt travel direction indicated by arrow A and presses against a secondary-transfer roller 9 via the intermediate transfer belt 7, thus forming a secondary-transfer nip therebetween. A predetermined voltage is applied to the secondary-transfer roller 9 or the secondary-transfer facing roller 9*a* to generate a secondary-transfer electrical field therebetween. Sheets P of recording media, fed by the sheet feeder 200 are transported in the direction indicated by arrow S shown in FIG. 1 (hereinafter "sheet conveyance direction"). When the sheet P passes through the secondary-transfer nip, the multicolor toner image is transferred from the intermediate transfer belt 7 onto the sheet P by the effects of the secondary-transfer electrical field (secondary-transfer process).

The fixing device 12 is disposed downstream from the secondary-transfer nip in the sheet conveyance direction. The fixing device 12 fixes the multicolor toner image with heat and pressure on the sheet P that has passed through the secondary-transfer nip, after which the sheet P is discharged outside the image forming apparatus 500. Meanwhile, a belt cleaning unit 11 removes toner remaining on the intermediate transfer belt 7 after the secondary-transfer process.

Additionally, toner bottles 400Y, 400M, 400C, and 400K containing respective color toners are provided above the intermediate transfer belt 7. The toner bottles 400 are removably installed in the apparatus body 100. Toner is supplied from the toner bottle 400 by a toner replenishing device to the developing device 4 for the corresponding color.

Figure 2:
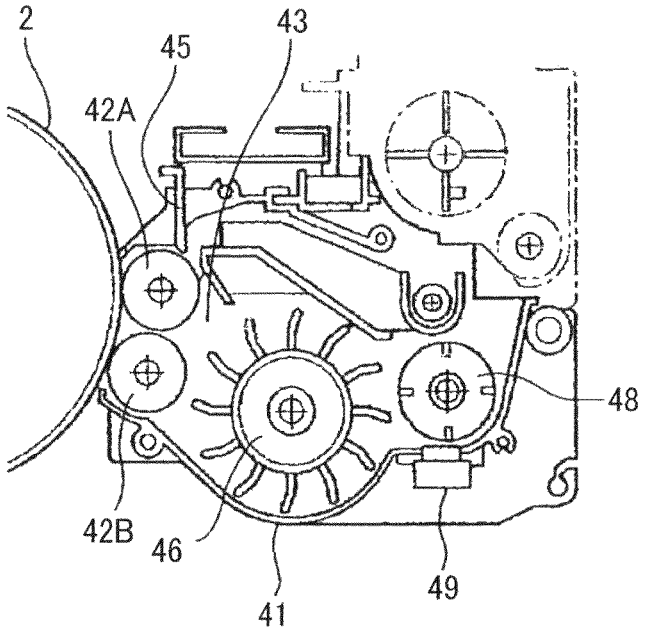
FIG. 2 is a schematic end-on axial view of a developing device incorporated in the image forming apparatus shown in FIG. 1.
Figure 3:
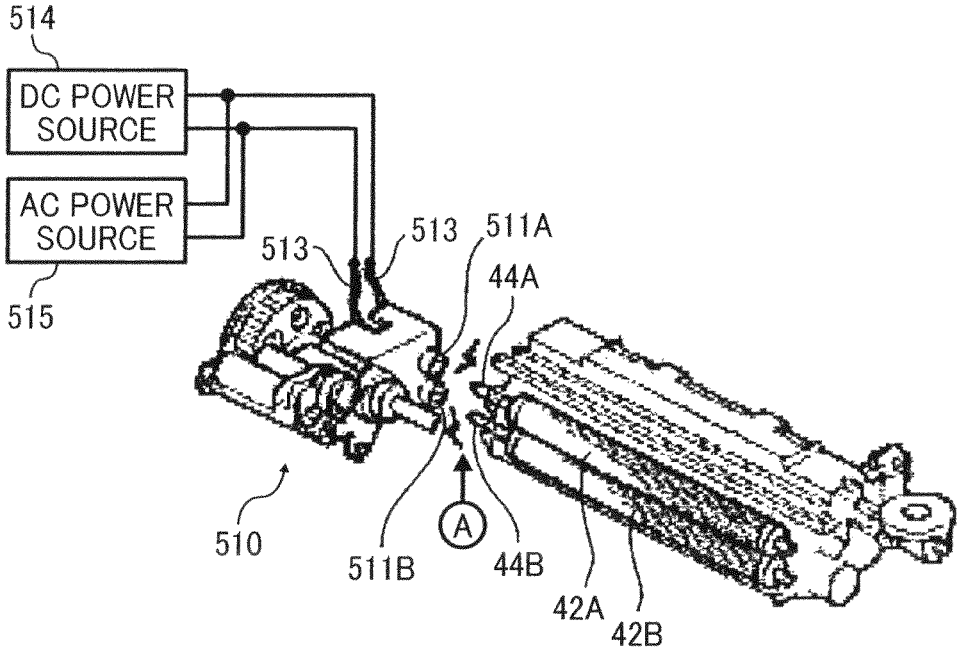
FIG. 3 is a perspective view illustrating the developing device and a power supply unit provided to a body of the image forming apparatus shown in FIG. 1.
Figure 4:
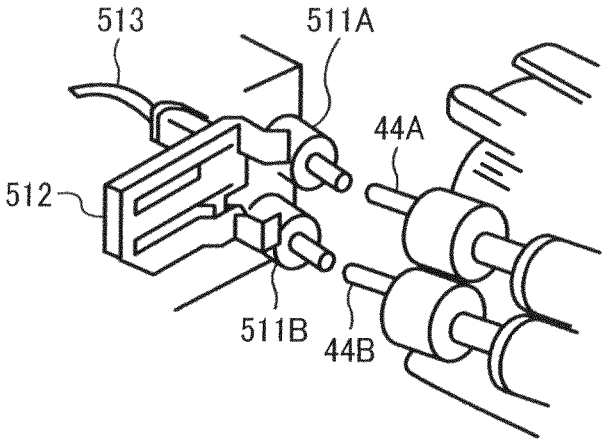
FIG. 4 is an enlarged perspective view illustrating a connecting section between the developing device and the power supply unit shown in FIG. 3.

FIG. 2 is a schematic end-on axial view of the developing device 4 according to the present embodiment, as viewed from the back of the paper on which FIG. 1 is drawn. FIG. 3 is a perspective view illustrating the developing device 4 and a power supply unit 510 provided to the apparatus body 100. FIG. 4 is an enlarged perspective view illustrating a connecting section (given reference character A in FIG. 3) between the developing device 4 and the power supply unit 510.

The developing device 4 includes two developing rollers, namely, first and second developing rollers 42A and 42B serving as developer bearers, a doctor blade 45, an agitation paddle 46, a conveying screw 48, and a toner density sensor or concentration detector 49. These components are housed in a development casing 41, which is open at a position facing the photoreceptor 2. Through the opening, the surface of the photoreceptor 2 faces the two developing rollers 42A and 42B. Although one-component developer consisting essentially of toner particles is used in the present embodiment, two-component developer consisting essentially of carrier (carrier particles) and toner may be used instead. It is to be noted that, in FIG. 2, reference number 43 represents developer contained in the development casing 41. Developer contained inside the development casing 41 is agitated by the agitation paddle 46 and the conveying screw 48.

The developer inside the development casing 41 is carried on the surfaces of the developing rollers 42A and 42B and transported to first and second development ranges, respectively, as the developing rollers 42A and 42B rotate. In the first and second development ranges, the developing rollers 42A and 42B face the photoreceptor 2, and image development is executed. After the doctor blade 45 adjusts the amount thereof, the developer carried on the first developing roller 42A is transported to the first development range and used in image development. Subsequently, the developer on the first developing roller 42A is forwarded to the developing roller 42B at the position where the first developing roller 42A faces the second developing roller 42B. As the second developing roller 42B rotates, the developer is further transported to the second development range and used again in image development.

The developing device 4 is provided with power input terminals 44A and 44B. As the process cartridge 1 is installed in the apparatus body 100, the power input terminals 44A and 44B of the developing device 4 therein are respectively inserted into terminal holes 511A and 511B of the power supply unit 510. Then, the power input terminals 44A and 44B of the developing device 4 contact a power output terminal 512 (shown in FIG. 4) of the power supply unit 510 provided to the apparatus body 100 and connected thereto electrically. A DC power source 514 for direct voltage application and an AC power source 515 for alternating voltage application are connected to the power output terminal 512 via a power cable 513. In the present embodiment, the DC power source 514 and the AC power source 515 together form an alternating voltage application unit.

An identical development voltage is applied to the developing rollers 42A and 42B. In the present embodiment, the development voltage is generated by superimposing alternating voltage output from the AC power source 515 on direct voltage output from the DC power source 514. The development voltage in the present embodiment is an alternating voltage whose polarity switches with the frequency of the alternating voltage output from the AC power source 515. In the present embodiment, the AC power source 515 outputs an alternating voltage having a peak-to-peak voltage of 750 V, a duty cycle (duty ratio) of 50%, and a rectangular waveform, for example. The DC power source 514 outputs a direct voltage of −250 V.

Figure 5:
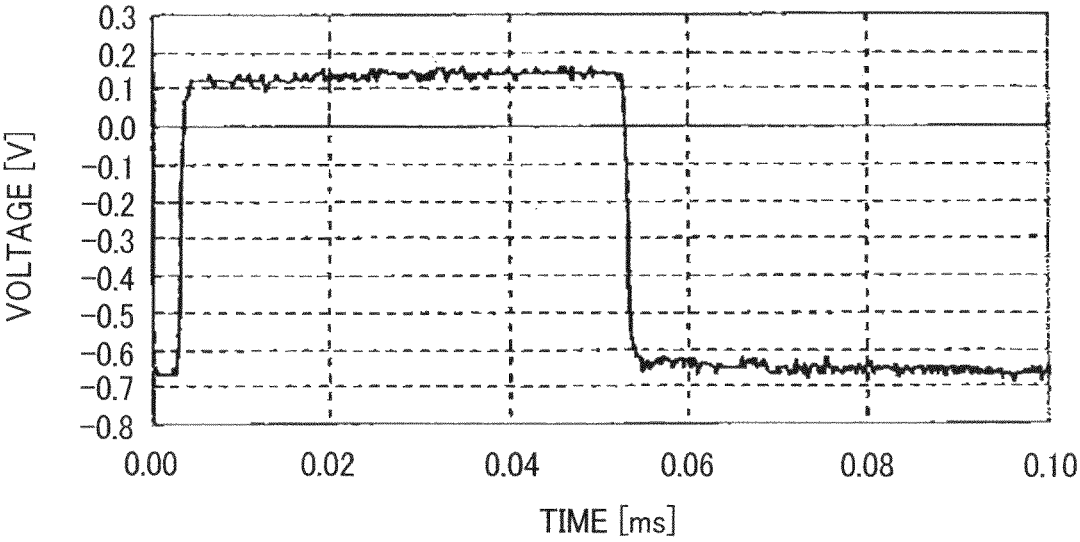
FIG. 5 is a graph illustrating a waveform of alternating voltage (development voltage) having a frequency of 10 kHz.
Figure 6:
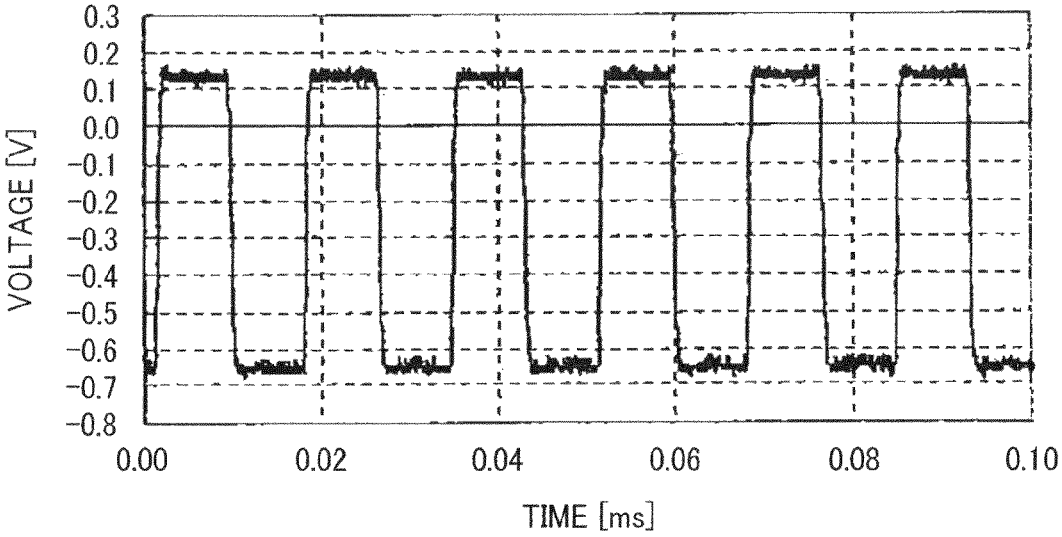
FIG. 6 is a graph illustrating a waveform of alternating voltage (development voltage) having a frequency of 60 kHz.

FIGS. 5 and 6 are graphs illustrating waveforms of the development voltage (alternating voltage) attained by such alternating voltage and direct voltage.

It is to be noted that FIG. 5 illustrates a waveform when the frequency of the alternating voltage is 10 kHz, and FIG. 6 illustrates a waveform when the frequency of the alternating voltage is 60 kHz.

Descriptions are given below of improvement of edge reproducibility in cases where alternating voltage development is employed.

As described above, edge reproducibility degradation is affected by scavenging, which is likely to arise when toner reciprocates with a large amplitude due to alternating electrical fields generated in the development range. The occurrence of scavenging and the degradation of edge reproducibility resulting therefrom can be alleviated by reducing the reciprocation amplitude of toner. However, when the peak-to-peak voltage of the alternating voltage is made smaller to reduce the reciprocation amplitude of toner, various merits of alternating voltage development are adversely affected.

In view of the foregoing, in the present embodiment, the frequency of the alternating voltage is increased, thereby reducing the reciprocation amplitude of toner. Specifically, the alternating voltage used as development voltage has a peak-to-peak voltage of 300 V or greater and a frequency within a range from 20 kHz to 60 kHz (including 20 kHz and 60 kHz).

Experiment 1

Now, descriptions are given of experiment 1 performed to ascertain improvement of edge reproducibility when the frequency of the alternating voltage applied to the developing rollers 42A and 42B is within a range from 20 kHz to 60 kHz to reduce the toner reciprocation amplitude.

Figure 7:
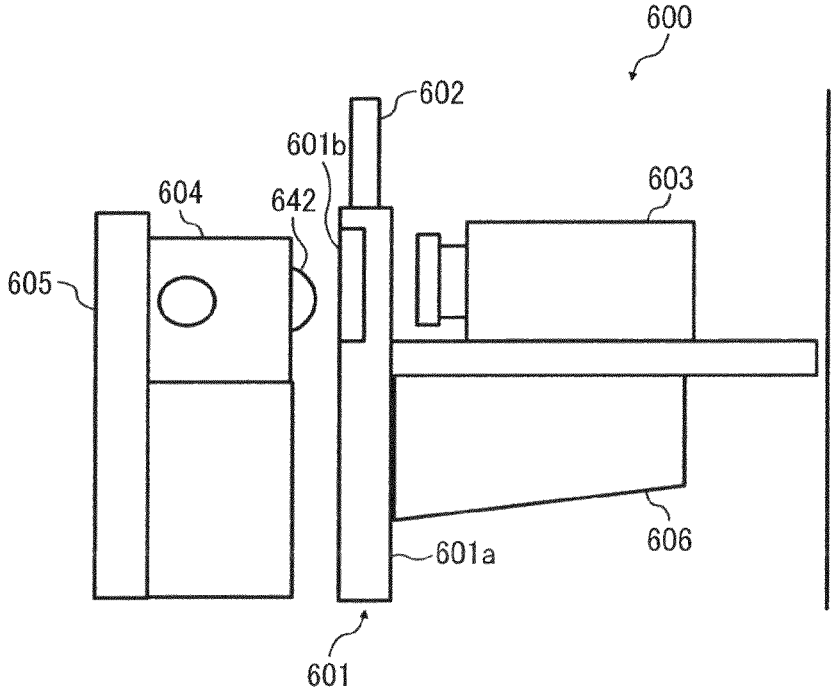
FIG. 7 is a schematic view of a simulator used in an experiment.
Figure 8:
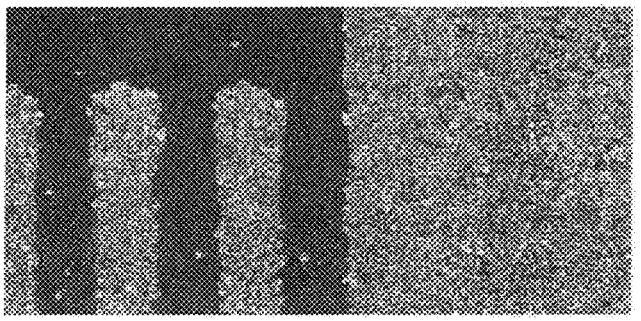
FIG. 8 is an example image taken by a high speed camera, showing development quality when direct voltage is applied to a developing roller of the simulator as development voltage.
Figure 9:
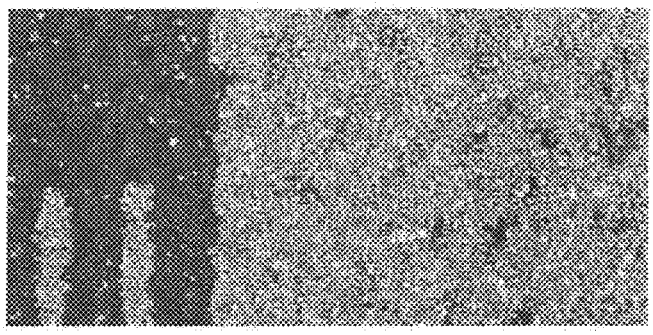
FIG. 9 is an example image taken by the high speed camera, showing development quality when alternating voltage (frequency of 2 kHz) is applied to the developing roller of the simulator shown in FIG. 7.
Figure 10:
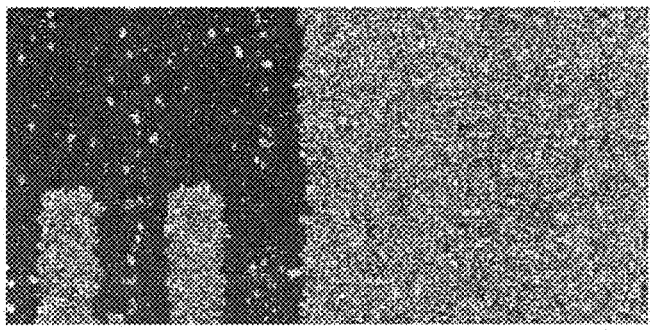
FIG. 10 is an example image taken by the high speed camera, showing development quality when alternating voltage (frequency of 9 kHz) is applied to the developing roller of the simulator shown in FIG. 7.
Figure 11:
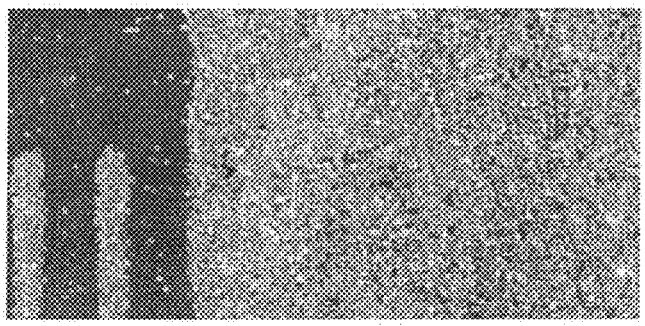
FIG. 11 is an example image taken by the high speed camera, showing development quality when alternating voltage (frequency of 10 kHz) is applied to the developing roller of the simulator shown in FIG. 7.
Figure 12:
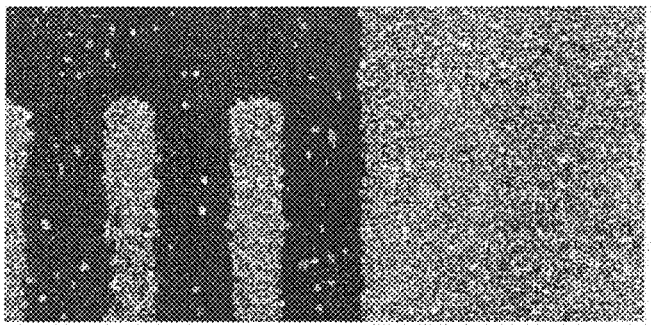
FIG. 12 is an example image taken by the high speed camera, showing development quality when alternating voltage (frequency of 20 kHz) is applied to the developing roller of the simulator shown in FIG. 7.
Figure 13:
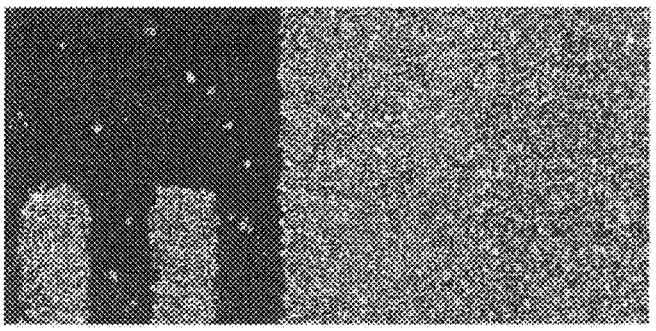
FIG. 13 is an example image taken by the high speed camera, showing development quality when alternating voltage (frequency of 40 kHz) is applied to the developing roller of the simulator shown in FIG. 7.
Figure 14:
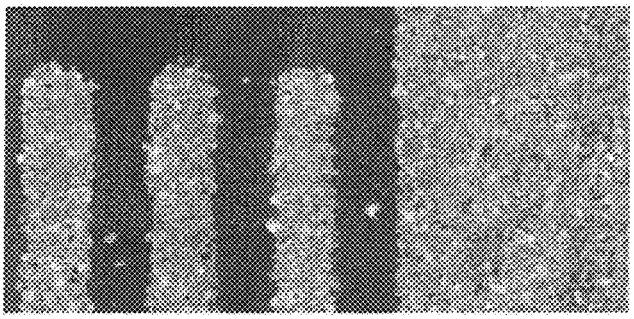
FIG. 14 is an example image taken by the high speed camera, showing development quality when alternating voltage (frequency of 60 kHz) is applied to the developing roller of the simulator shown in FIG. 7.
Figure 15:
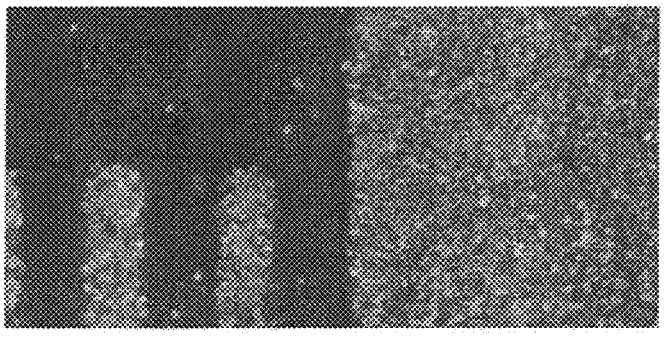
FIG. 15 is an example image taken by the high speed camera, showing development quality when alternating voltage (frequency of 70 kHz) is applied to the developing roller of the simulator shown in FIG. 7.
Figure 16:
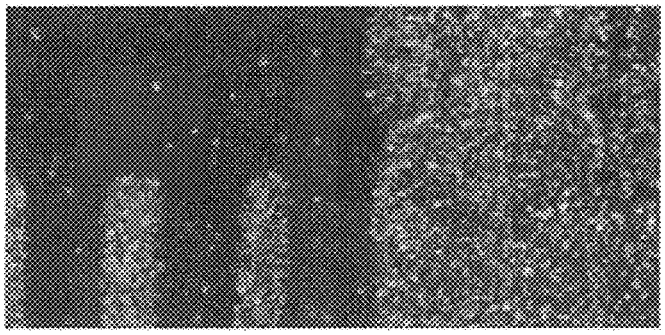
FIG. 16 is an example image taken by the high speed camera, showing development quality when alternating voltage (frequency of 80 kHz) is applied to the developing roller of the simulator shown in FIG. 7.
Figure 17:
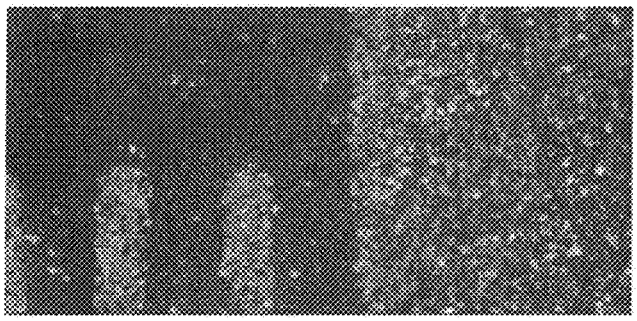
FIG. 17 is an example image taken by the high speed camera, showing development quality when alternating voltage (frequency of 100 kHz) is applied to the developing roller of the simulator shown in FIG. 7.

FIG. 7 is a schematic end-on view of a simulator 600 used in experiment 1.

The simulator 600 includes a dummy photoreceptor 601 constructed of a transparent glass substrate 601*a* and an indium tin oxide (ITO) layer 601*b* that is a transparent electrode, deposited on the glass substrate 601*a*. The simulator 600 further includes an electrode 602 to apply voltage to the ITO layer 601*b*, a high speed camera 603, and a developing unit 604. Although the developing unit 604 includes a single developing roller 642, differently from the developing device 4 according to the present embodiment in which two developing rollers 42A and 42B are provided, the configuration of the developing unit 604 is similar other than that. The developing unit 604 is fixed to a stationary base 605 such that the developing roller 642 faces the dummy photoreceptor 601.

The dummy photoreceptor 601 and the high speed camera 603 are supported by a movable table 606. The movable table 606 can slidably move vertically in FIG. 7 so that the surface of the dummy photoreceptor 601 where the ITO layer 601*b* is deposited passes through a position opposed to the developing roller 642. The high speed camera 603 is disposed at a position to capture toner adhering to a latent image portion (i.e., dummy latent image portion) from a back side of the dummy photoreceptor 601. The back side of the dummy photoreceptor 601 means the side opposite the surface on which the ITO layer 601*b* is deposited.

Experiment 1 was conducted as follows. Initially, move down the movable table 606 supporting the dummy photoreceptor 601 and the high speed camera 603. Apply a direct voltage of −190 V to the latent image portion of the dummy photoreceptor 601, thereby setting a dummy latent image potential V1 to −190, and apply a direct voltage of −350 V to a background portion (i.e., dummy non-image portion) of the dummy photoreceptor 601, thereby setting a dummy background potential Vd to −350 V. Subsequently, apply alternating voltage to the developing roller 642 similarly to the present embodiment, start the developing unit 604, and move up the movable table 606 slidably. The speed of the sliding movement was identical to that of the linear velocity (surface movement velocity) of the photoreceptor 2 according to the present embodiment. Then, observe, with the high speed camera 603, the quality of development of the dummy latent image portion and the background portion on the dummy photoreceptor 601 that have passed through the development range facing the developing roller 642.

In experiment 1, the development quality was observed while only the frequency of the alternating voltage applied to the developing roller 642 was varied (direct voltage Vdc and peak-to-peak voltage Vpp were not varied). Specifically, the frequency of the alternating voltage was varied in 10 steps of 0 kHz (that is, direct voltage only), 2 kHz, 9 kHz, 10 kHz, 20 kHz, 40 kHz, 60 kHz, 70 kHz, 80 kHz, and 100 kHz. Table 1 below shows other conditions in experiment 1.

TABLE 1

| Voltage type | Vpp (V) | Vdc (V) | Duty (%) | f (kHz) | Vl (V) | Vd (V) |
|---|---|---|---|---|---|---|
| Direct voltage | | | | 0 | −190 | −350 |
| Alternating voltage + Direct voltage | 1500 | −250 | 50 | 2 | | |
| | | | | 9 | | |
| | | | | 10 | | |
| | | | | 20 | | |
| | | | | 40 | | |
| | | | | 60 | | |
| | | | | 70 | | |
| | | | | 80 | | |
| | | | | 100 | | |

FIGS. 8 through 17 are examples of images taken by the high speed camera 603, showing the development quality at each frequency of the alternating voltage applied to the developing roller 642.

A dummy latent pattern formed on the dummy photoreceptor 601 includes thin lines of 100 μm and bold lines of 1060 μm. The images shown in FIGS. 8 through 17 were produced by cutting out a picture taken by the high speed camera 603 partly into a width of 512 pixels and a height of 256 pixels (1 pixel=1 μm) such that two or three thin lines of 100 μm were on the left side with the ends thereof visible and the bold line of 1060 μm was partly present on the right.

In the present experiment, three items of filling of solid portions (i.e., toner absence in solid portions), brightness, and edge reproducibility of the images taken by the high speed camera 603 were evaluated.

Figure 18:
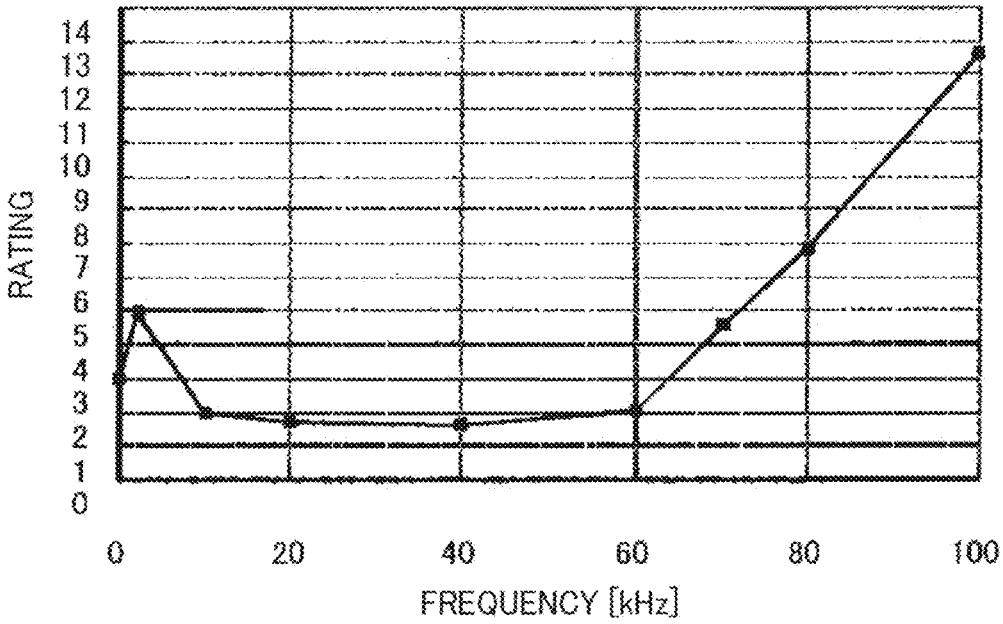
FIG. 18 is a graph illustrating evaluation results of toner absence in solid portions (filling of solid portions) in the experiment.

The evaluation of filling of solid portions is shown as toner absence rating in FIG. 18 and means to what degree solid portions are filled with toner. Evaluation was made as follows. Cut out a portion of 100 pixels (width)×256 pixels (height) including only a solid image portion (bold line portion) from the captured image, and measure the area in which toner is absent (toner absent area) of the bold line portion. As this area decreases, it is highly evaluated. The measurement of toner absent area was 2455 pixels when the alternating voltage was 0 kHz, which was used as a reference of 3.0, and measurements were standardized so that the best (toner absence area is 0 square pixel) fell on 1.0.

FIG. 18 is a graph illustrating toner absence ratings as evaluation results of filling in solid portions in the experiment.

As shown in FIG. 18, toner absence rating at a frequency of 2 kHz is 5.0, that at 9 kHz is 2.0, that at 10 kHz is 2.0, that at 20 kHz is 1.7, that at 40 kHz is 1.6, that at 60 kHz is 2.0, that at 70 kHz is 4.5, that at 80 kHz is 6.9, and that at 100 kHz is 12.6.

In this graph, the abscissa represents the frequency, and the ordinate represents the rating. As can be known from this graph, when the frequency of the alternating voltage applied to the developing roller 642 is within a range from 9 kHz to 60 kHz, the toner absence rating is 2.0 or lower. When the frequency deviates from this range, the rating increases significantly. That is, filling of solid portions is degraded significantly. From the results, it is confirmed that, compared with direct voltage development in which the frequency of alternating voltage is 0 kHz, when an alternating voltage within a range from 9 kHz to 60 kHz (20 and 60 kHz inclusive) is used as development voltage, filling of solid portions is improved, thus attaining the merit of alternating voltage development.

Next, evaluation of brightness is described.

Brightness is an important factor that relates to color reproducibility. Brightness evaluation means quantitative evaluation of toner lamination states. Specifically, the evaluation was made as follows. Cut out a portion including a solid image portion (bold line portion. Evaluate the average of brightness values of the bold line portion using a relative brightness converted as a relative value in relation to the brightness of the background portion. As this value increases, it is highly evaluated. In the evaluation, the brightness values were standardized so that the brightness value at the frequency of 0 kHz (direct voltage) fell on a rating of 3.0 (reference rating).

Figure 19:
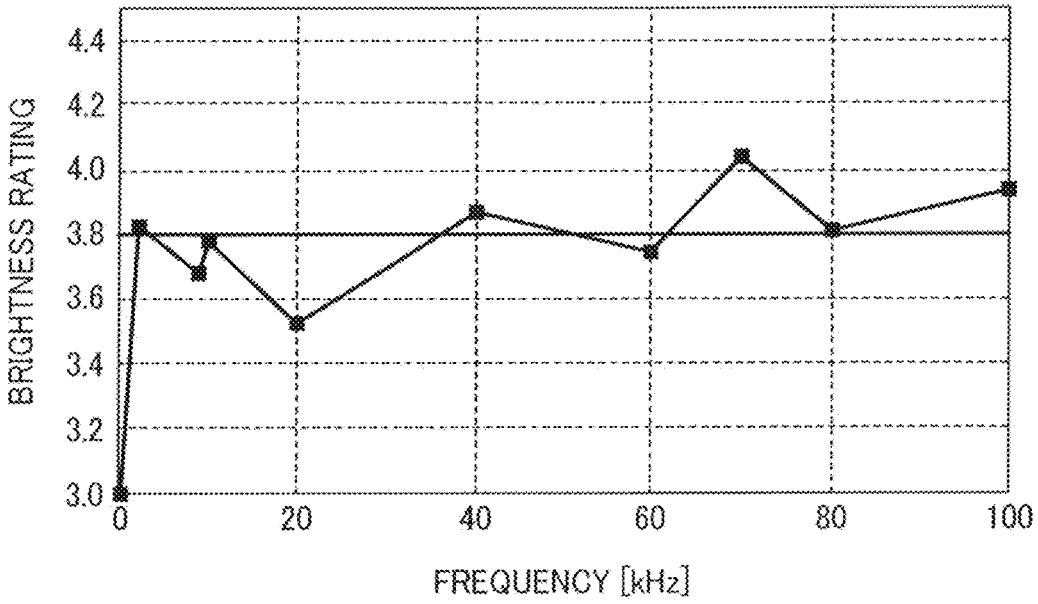
FIG. 19 is a graph illustrating brightness ratings in the experiment.

FIG. 19 is a graph illustrating brightness ratings in the experiment.

In this graph, the abscissa represents the frequency, and the ordinate represents the rating. From the results shown in FIG. 19, it is confirmed that, compared with direct voltage development in which the frequency of the alternating voltage is 0 kHz, use of alternating voltage at any of frequencies used in the experiment as development voltage can enhance the brightness, thus attaining the merit of alternating voltage development.

Next, evaluation of edge reproducibility is described.

In evaluation of edge reproducibility, it is evaluated whether or not toner is present at edges of a latent image portion adjacent to a non-image area (i.e., background) and whether or not edges of a resultant image are fully reproduced. Specifically, the evaluation was made as follows. On the captured image, set a measurement range of 20-pixel wide to include an edge portion extending vertically in a lateral center portion of the images shown in FIGS. 9 through 17. From the top to the bottom within the measurement range of the captured image, acquire coordinates of positions at which brightness changes significantly in the width direction, and calculate standard deviation thereof.

As the standard deviation decreases, it is deemed that edge reproducibility is good. In the evaluation, the standard deviations at the respective frequencies were standardized so that the standard deviation at the frequency of 0 kHz (direct voltage) fell on a rating of 3.0 (reference rating) and the best (standard deviation zero) fell on a rating of 1.0.

Figure 20:
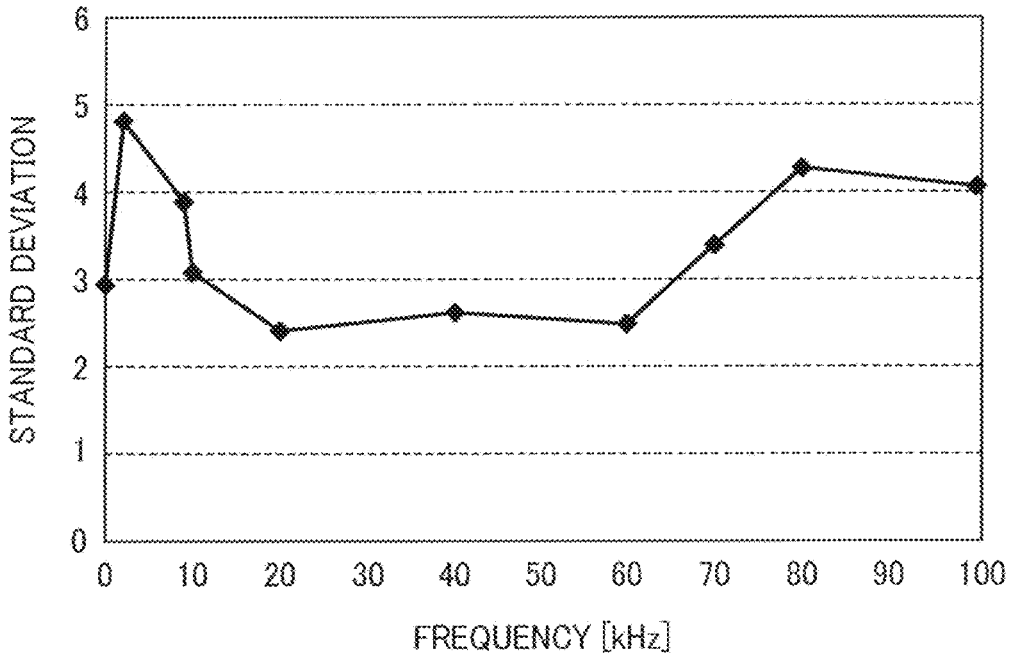
FIG. 20 is a graph illustrating results of edge reproducibility evaluation.

FIG. 20 is a graph illustrating results of edge reproducibility evaluation.

In this graph, the abscissa represents the frequency, and the ordinate represents the rating. As be known from this graph, when the frequency of the alternating voltage applied to the developing roller 642 is within a range from 20 kHz to 60 kHz (20 kHz and 60 kHz inclusive), the standard deviation is smaller than the reference rating 3.0. From the results, it is confirmed that, compared with direct voltage development, uses of an alternating voltage having a frequency within a range from 20 kHz to 60 kHz (20 kHz and 60 kHz inclusive) as development voltages can improve edge reproducibility from that in direct voltage application.

To evaluate the three items comprehensively, comprehensive ratings at the respective frequencies were standardized so that the comprehensive rating at the frequency of 0 kHz (direct voltage) fell on a reference rating of 3.0 and the best fell on a rating of 1.0. It is to be noted that the brightness ratings are converted so that the value becomes smaller as the brightness increases. As the result of comprehensive evaluation, the rating at 2 kHz is 4.6, that at 9 kHz is 3.2, that at 10 kHz is 3.0, that at 20 kHz is 2.6, that at 40 kHz is 2.7, that at 60 kHz is 2.8, that at 70 kHz is 4.0, that at 80 kHz is 5.0, and that at 100 kHz is 7.0.

Thus, according to the comprehensive evaluation including filling of solid portions, brightness, and edge reproducibility, the comprehensive rating is better than the reference of 3.0 when the frequency is not smaller than 20 kHz and not greater than 60 kHz. Accordingly, it is confirmed that filling of solid portions, brightness, and edge reproducibility can be enhanced by using, as development voltage, alternating voltage having a frequency within a range from 20 kHz to 60 kHz compared with those in direct voltage development.

Further, effects of the peak-to-peak voltage given to these three evaluation items, namely, filling of solid portions, brightness, and edge reproducibility, were researched regarding the above-described preferable frequency range of 20 kHz to 60 kHz by varying the peak-to-peak voltage Vpp of the alternating voltage. According to the research, although the respective ratings become lower as the peak-to-peak voltage is reduced gradually from 1500 V, any of the evaluation results is better than that in direct voltage development when the peak-to-peak voltage Vpp is 300 V or greater.

Next, toner usable in the present embodiment is described below.

The area rate of toner adhering to the background (background toner stains) and the amount of scattering toner were evaluated in three cases in which toner particle size is one of three different ranges: smaller than 4 μm, from 4 μm to 7 μm, and greater than 7 μm. According to the evaluation results, when the particle size is within a range of 5 μm±1 μm, the solid filling evaluation and brightness evaluation are lowered by 5%, but background stains and toner scattering are alleviated by 30%, compared with the case in which the particle size is smaller than 4 μm. Additionally, compared with the case in which the toner particle size is greater than 7 μm, the evaluations of background stains and toner scattering are increased by 5%, and the evaluations of solid image filling and brightness are improved by 20%. In the present embodiment, for example, toner having a particle size of 5 μm±1 μm is used.

Next, descriptions are given of carrier in cases where two-component developer is used in the present embodiment.

It was observed that the number of toner particles leaving carrier particles increased by 30% when the volume specific resistance value was changed from $1.0\times10^{19}$ Ω·cm to a range from $1.0\times10^{8}$ Ω·cm to $1.0\times10^{10}$ Ω·cm. The number of toner particles leaving carrier particles per unit time were visualized and observed using a high speed camera. When two-component developer is used in the present embodiment, the volume resistance value of carrier is set to about $1.0\times10^{8.9}$ Ω·cm.

As described above, according to the present embodiment, edge reproducibility can improve when the frequency of the alternating voltage applied to the developing rollers 42A and 42B is 20 kHz or greater and 60 kHz or smaller.

The reciprocation amplitude of toner in the development range at that time is described below.

An apparent amplitude D of toner reciprocating in the development range can be expressed as follows when Eo represents the strength of electrical field formed in the development range, f represents the frequency of the alternating voltage, and q represents the charge amount of toner.

$$D=q\times Eo/(2\pi f)^2 \qquad \text{Formula 1}$$

The electrical field Eo in the development range can be obtained from the following formula using a distance d between the developing rollers 42A and 42B and the photoreceptor 2 and the peak-to-peak voltage Vpp of the alternating voltage.

$$Eo=Vpp/d \qquad \text{Formula 2}$$

The charge amount q of toner can be obtained from the following formula using a mass m of toner and a sum q' of charge amount of toner of 1 gram. An apparent volume V of toner can be calculate based on a radius r of toner. The mass m of toner can be obtained from the apparent volume V and a toner density ρ (m=V×ρ).

$$q=q'/m \qquad \text{Formula 3}$$

According to formula 1, the amplitude D of toner thus obtained is inversely proportional to the square of the frequency f. Accordingly, the amplitude D of toner decreases significantly as the frequency f increases. It was confirmed that, under the conditions of the above-described experiment, the amplitude D of toner was greater than 300 μm when the frequency of the alternating voltage was 2 kHz, and the amplitude D decreased gradually as the frequency increased. Under the conditions of the above-described experiment, however, the observed amplitude of toner was smaller than the amplitude D calculated according to formula 1 since the non-development field formed in the development range was smaller than the development field. In the above-described experiment, when the frequency was within the range from 20 kHz to 60 kHz that contributes to the desirable evaluation results, the amplitude D of toner was 0.3 μm or greater and 30 μm or smaller according to the observation results.

[Variation]

Next, descriptions are given of a variation of the alternating voltage applied to the developing rollers 42A and 42B of the developing device 4 according to the above-described embodiment.

Figure 21:
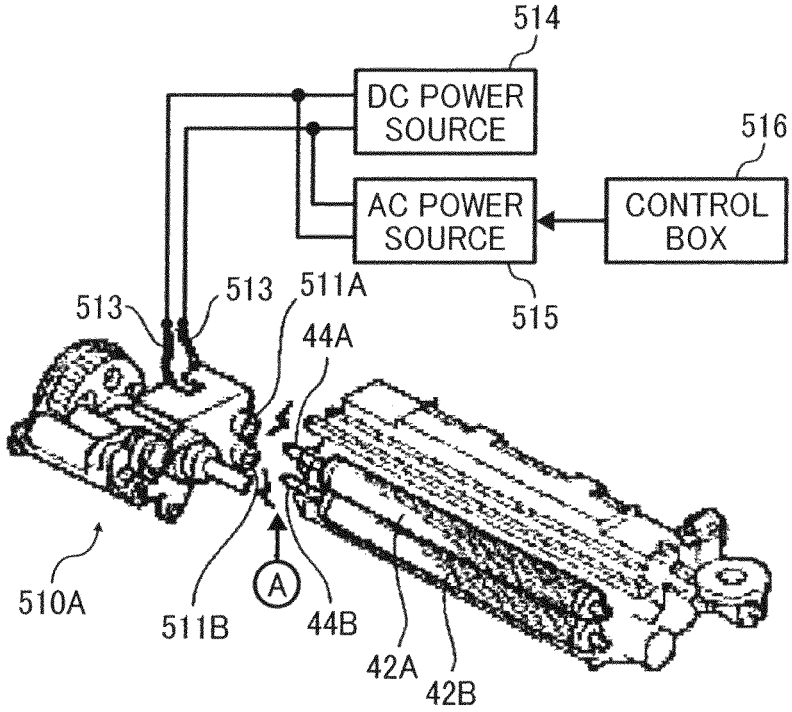
FIG. 21 is a perspective view illustrating a developing device and a power supply unit according to a variation, provided to a body of the image forming apparatus shown in FIG. 1.

FIG. 21 is a perspective view illustrating the developing device 4 and a power supply unit 510A according to the present variation, provided to the apparatus body 100.

The power supply unit 510A is provided with a control box 516 to control the AC power source 515. The control box 516 is connected to the AC power source 515, and the waveform of the alternating voltage output from the AC power source 515 can be varied by control signals output from the control box 516.

Figure 22:
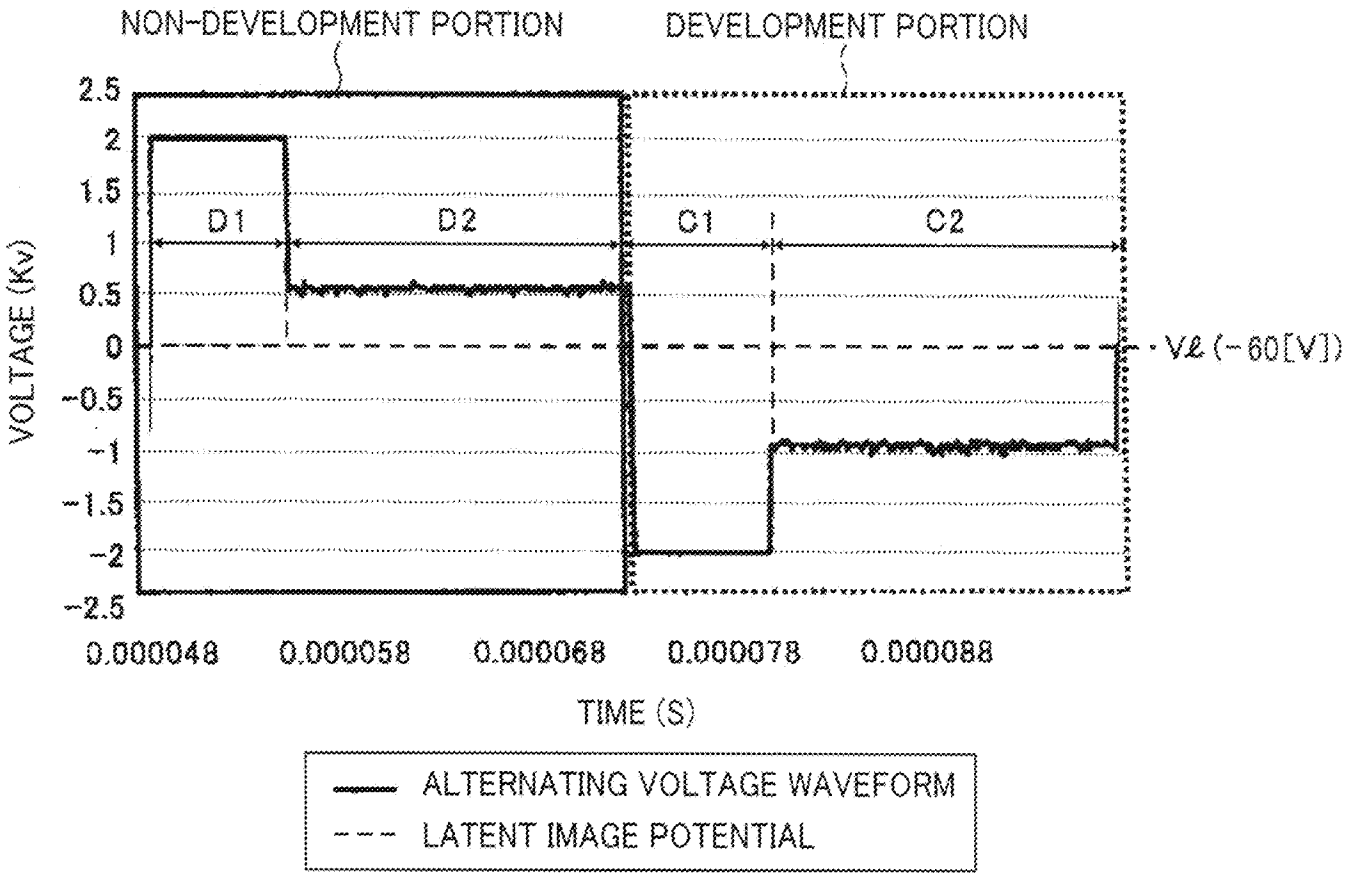
FIG. 22 is a graph illustrating a waveform of alternating voltage output from the power supply unit shown in FIG. 21.

FIG. 22 is a graph of a waveform of the alternating voltage output from the power supply unit 510A shown in FIG. 21.

In the alternating voltage waveform, a development portion having a polarity in the direction to move toner from developing rollers 42A and 42B to the photoreceptor 2 (developing direction) and a non-development portion having a polarity in the direction to move toner from the photoreceptor 2 to the developing rollers 42A and 42B (non-developing direction) are alternately present according to the frequency of the alternating voltage. Toner used in the present variation has a normal charge polarity that is negative similar to the above-described embodiment. Accordingly, in the graph shown in FIG. 22, a waveform portion enclosed by solid lines is the non-development portion, and a waveform portion enclosed by broken lines is the development portion.

In the present variation, as illustrated in FIG. 22, a leading end portion of the development portion enclosed by broken lines has an absolute voltage value greater than that of a rest C2 of the development portion. The leading end portion is hereinafter referred to as a spike portion C1.

Additionally, in FIG. 22, a leading end portion of the non-development portion enclosed by solid lines has an absolute voltage value greater than that of a rest D2 of the non-development portion. The leading end portion is hereinafter referred to as a spike portion D1.

The waveform shown in FIG. 22 is described in further detail below.

The frequency of the alternating voltage is 20.1 kHz. For a period from a time count 0.000048 second after the start of the power supply unit 510A to a time count of 0.0000544 second, a positive polarity voltage of +2 kV (spike portion) is applied. Subsequently, the voltage is returned to a normal voltage of +500 V. Further, a negative polarity voltage of −2 kV (spike portion) is applied for a period from 0.0000729 second to 0.0000799 second, and the voltage is returned to a normal voltage of −1 kV.

Development efficiencies can be improved and background stains can be reduced by using the alternating voltage having such spike portions compared with a case in which the alternating voltage does not include the spike portions. Functions of the spike portions to attain such effects are described below. It is to be noted that there are differences between the spike portion C1 of the development portion and the spike portion D1 of the non-development portion, and accordingly they are described separately.

Figure 23:
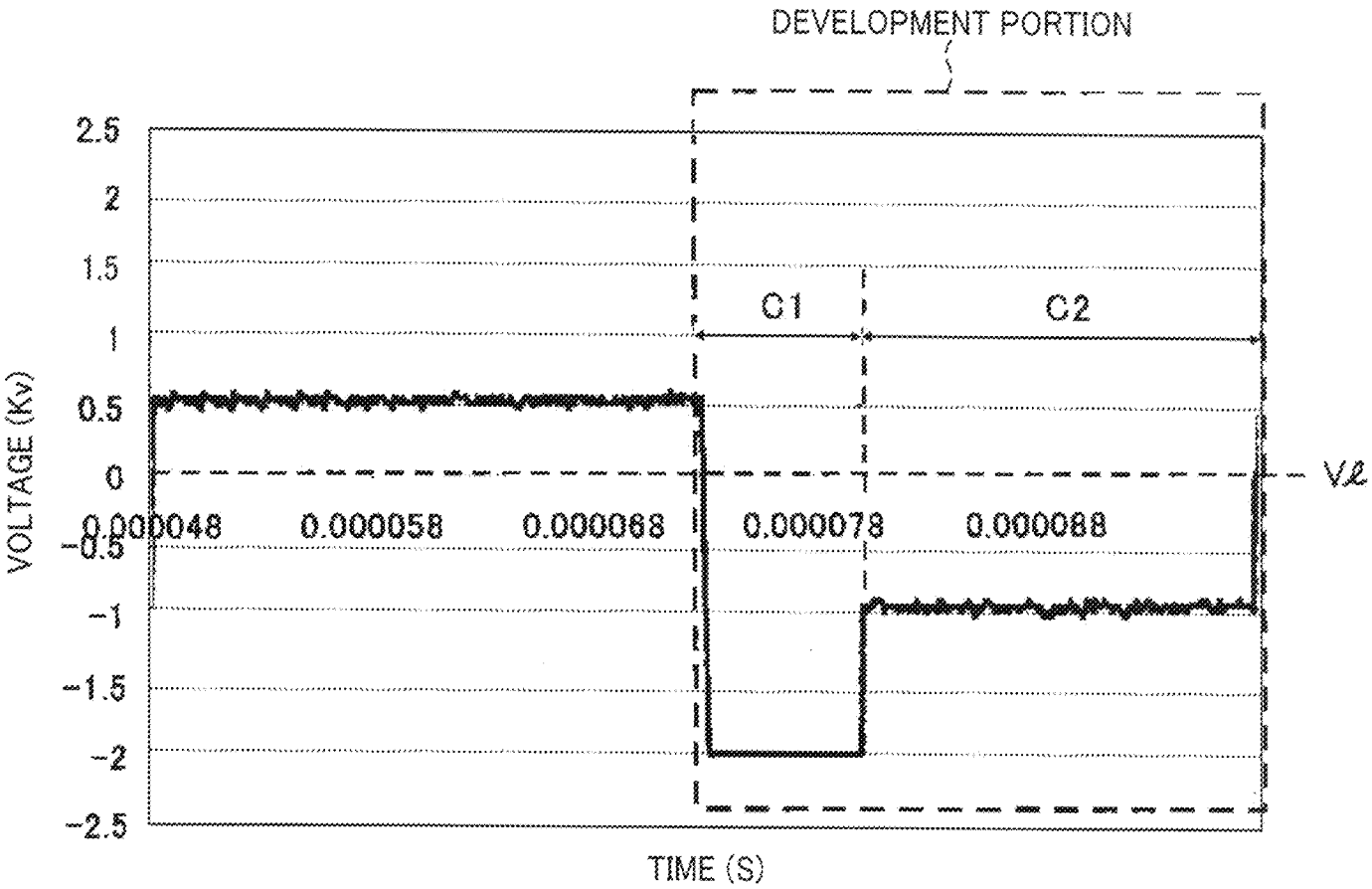
FIG. 23 is a graph illustrating a waveform that includes a spike portion only in a development waveform portion of the alternating voltage shown in FIG. 22.

FIG. 23 is a graph illustrating a waveform that includes the spike portion C1 only in the development portion of the alternating voltage waveform shown in FIG. 22.

That is, the waveform shown in FIG. 23 is produced by removing the spike portion D1 of the non-development portion in the waveform shown in FIG. 22, thereby making the non-development portion into a normal waveform.

Experiment 2

Experiment 2 was conducted to evaluate images developed using the alternating voltage having such a waveform regarding the development efficiency and background stains. Experiment 2 was conducted under the conditions of: the sum of charge amount of 1-gram toner was −30 μC/g±10 μC/g; the latent image potential (V1) on the photoreceptor 2 was −60V; the peak-to-peak voltage Vpp of the alternating voltage was 1500 V; the direct component of the alternating voltage was −250 V; and the alternating voltage had a duty cycle of 50%, a rectangular waveform, and a frequency of 20.1 kHz.

In the development portion enclosed by broken lines in FIG. 23, the voltage applied to the developing rollers 42A and 42B falls on the negative polarity side relative to the latent image potential V1 (−60 V). Accordingly, in the development range, a development field having a strength in accordance with the potential difference therebetween is generated. The difference of the spike portion C1 from the latent image potential V1 is greater than the difference of the rest C2 from the latent image potential V1. Therefore, the development field is stronger during the period in which the spike portion C1 is applied, thus moving a greater amount of toner to the photoreceptor 2, than the period in which the rest C2 is applied. Therefore, the development efficiency can be higher compared with the case in which the development portion does not includes the spike portion C1.

Here, if the entire development portion including the rest C2 is made identical in voltage value to the spike portion C1 (−2 kV), the amount of toner scattering on the background portion of the photoreceptor 2 is likely to increase, thus worsening background stains, although the development efficiency may improve. Additionally, the possibility of occurrence of electric discharge in the development range increases. As a result, abnormal charging of toner arises, thereby degrading filling of solid portions, brightness, and edge reproducibility and causing wear of the photoreceptor 2. Therefore, it is preferred that the spike portion C1 is present only partly in the development portion, more specifically, at the leading end of the development portion. The duration (time width) of the spike portion C1 is preferably shorter than that of the rest C2.

The partial presence of the spike portion C1 in the development portion can improve development efficiencies, which is effective in enhancing filling of solid portions, brightness, and edge reproducibility. Therefore, these three evaluation items can be enhanced by using, as the development voltage, the alternating voltage having a frequency within a range from 20 kHz to 60 kHz (20 kHz and 60 inclusive) and including the spike portion C1 in the development portion thereof.

It is to be noted that the frequency range to attain effects of the partial presence of the spike portion C1 in the development portion is not limited to the above-described range from 20 kHz to 60 kHz. In particular, edge reproducibility can improve by the partial presence of the spike portion C1 in the development portion even when the frequency is within a range from 10 kHz to 60 kHz (10 kHz and 60 kHz inclusive) to a degree similar to the above-described configuration with reference to FIGS. 3 to 20, in which the alternating voltage has a frequency from 20 kHz to 60 kHz and does not include the spike portion C1 in the development portion.

Figure 24:
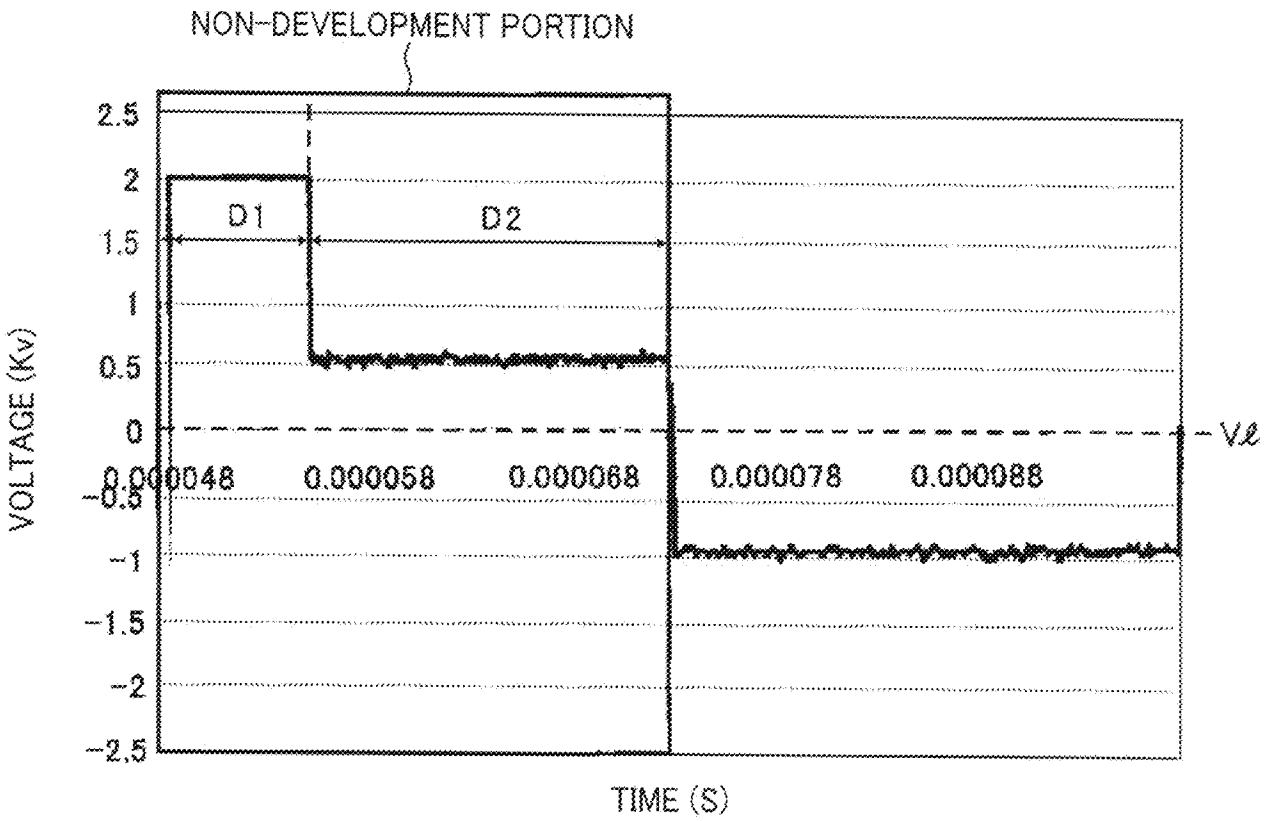
FIG. 24 is a graph illustrating a waveform that includes a spike portion only in a non-development portion of the alternating voltage shown in FIG. 22.

In the development portion enclosed by solid lines in FIG. 24, the voltage applied to the developing rollers 42A and 42B falls on the positive polarity side relative to the latent image potential V1 (−60 V). Accordingly, in the development range, a non-development field (to return toner from the photoreceptor 2 to the developing rollers 42A and 42B) having a strength in accordance with the potential difference therebetween is generated. Compared with the rest D2 of the non-development portion, the difference of the pike waveform D1 from the latent image potential V1 is greater. Therefore, the non-development field is stronger during the period in which the spike portion D1 is applied, thus returning a greater amount of toner to the developing rollers 42A and 42B, than the period in which the rest D2 of the non-development portion is applied. Therefore, the toner adhering to the background portion can be better collected to the developing rollers 42A and 42B, thus inhibiting background stains, compared with the case in which the non-development portion does not includes the spike portion D1.

Here, if the entire non-development portion including the rest D2 is made identical in voltage value to the spike portion D1 (+2 kV), the possibility of occurrence of electric discharge in the development range increases although background stains may be alleviated. As a result, abnormal charging of toner arises, thereby degrading filling of solid portions, brightness, and edge reproducibility and causing wear of the photoreceptor 2. Therefore, by providing the spike portion D1 only partly in the non-development portion, more specifically, at the leading end of the non-development portion, background stains can be alleviated while inhibiting the occurrence of electric discharge.

The partial presence of the spike portion D1 in the non-development portion can improve edge reproducibility since toner adhering to the background portion adjacent to the edges of image portions can be collected by the spike portion D1. Therefore, edge reproducibility can be enhanced by using, as the development voltage, the alternating voltage having a frequency within a range from 20 kHz to 60 kHz (20 kHz and 60 kHz inclusive) and including the spike portion D1 in the non-development portion thereof.

It is to be noted that the frequency range to attain the effects of the partial presence of the spike portion D1 in the non-development portion is not limited to the above-described range from 20 kHz to 60 kHz. In particular, edge reproducibility can improve by the partial presence of the spike portion D1 in the non-development portion even when the frequency is within a range from 10 kHz to 60 kHz (10 kHz and 60 kHz inclusive) to a degree similar to the above-described configuration with reference to FIGS. 3 to 20, in which the alternating voltage has a frequency from 20 kHz to 60 kHz and does not include the spike portion D1 in the non-development portion. The duration (time width) of the spike portion D1 is preferably shorter than that of the rest D2 of the non-development portion.

The various aspects of the present specification can attain specific effects as follows.

(Aspect A)

In a developing device that includes a developer bearer, such as the developing rollers 42A and 42B, disposed facing a latent image bearer, such as the photoreceptor 2, and an alternating voltage application unit, such as the power supply unit 510, to apply alternating voltage to the developer bearer to generate an alternating electrical field in a development range to cause toner to move from the developer bearer to the latent image bearer while reciprocating therebetween, the alternating voltage has a frequency within a range from 10 kHz to 60 kHz, more preferably from 20 kHz to 60 kHz, and a peak-to-peak voltage equal to or greater than 300 V.

As described above, this configuration can inhibit degradation of edge reproducibility inherent to alternating voltage development.

(Aspect B)

In aspect A, the alternating voltage application unit, such as the power supply unit 510A, includes an AC power source controller, such as the control box 516, to control the AC power source 515 to vary the waveform of the alternating voltage output from the AC power source 515. This configuration can design the waveform of the above-described alternating voltage such that the leading end portion (i.e., spike portion C1) of the development portion having the polarity in the direction to move toner from the developer bearer to the latent image bearer has an absolute voltage value greater than that of the rest C2 of the development portion.

This configuration can improve the development efficiency and accordingly further inhibit degradation of edge reproducibility.

(Aspect C)

In aspect A or B, the waveform of the above-described alternating voltage is configured such that the leading end portion (i.e., spike portion D1) of the non-development portion having the polarity in the direction to move toner from the latent image bearer to the developer bearer has an absolute voltage value greater than that of the rest D2 of the non-development portion.

This configuration can suppress background stains and accordingly further inhibit degradation of edge reproducibility.

(Aspect D)

In aspect B, the duration of the leading end portion of the development portion is shorter than the rest thereof. Alternatively, in aspect C, the duration of the leading end portion of the non-development portion is shorter than the rest thereof.

This configuration can attain at least one of development efficiency improvement or background stain reduction while inhibiting other inconveniences.

(Aspect E)

In any of aspects A through D, the alternating voltage causes toner to reciprocate in an amplitude within a range from 0.3 μm to 30 μm (0.3 μm and 30 μm inclusive).

As described above, this configuration can inhibit degradation of edge reproducibility inherent to alternating voltage development.

(Aspect F)

In a developing device including a developer bearer disposed facing the latent image bearer and an alternating voltage application unit to apply alternating voltage to the developer bearer to generate an alternating electrical field in a development range to cause toner to move from the developer bearer to the latent image bearer while reciprocating therebetween, the alternating voltage has a frequency within a range from 10 kHz to 60 kHz and a peak-to-peak voltage of 300 V or greater. Further, the waveform of the above-described alternating voltage is configured such that the leading end portion (i.e., spike portion C1) of the development portion has an absolute voltage value greater than that of the rest C2 of the development portion.

With this configuration, even when the frequency is reduced from the above-described range (20 kHz to 60 kHz), degradation of edge reproducibility inherent to alternating voltage development can be inhibited.

(Aspect G)

In a developing device including a developer bearer disposed facing the latent image bearer and an alternating voltage application unit to apply alternating voltage to the developer bearer to generate an alternating electrical field in a development range to cause toner to move from the developer bearer to the latent image bearer while reciprocating therebetween, the alternating voltage has a frequency within a range from 10 kHz to 60 kHz and a peak-to-peak voltage of 300 V or greater. Further, the waveform of the above-described alternating voltage is configured such that the leading end portion (i.e., spike portion D1) of the non-development portion having the polarity to move toner from the latent image bearer to the developer bearer has an absolute voltage value greater than that of the rest D2 of the non-development portion.

With this configuration, even when the frequency is reduced from that in aspect A, degradation of edge reproducibility inherent to alternating voltage development can be inhibited.

(Aspect H)

In any of aspects A through G, toner has a volume average particle diameter within a range from 4 μm to 7 μm.

This configuration can suppress toner stains on the background and reduce the amount of scattering toner.

(Aspect I)

In any of aspects A through H, the developer bearer carries two-component developer including toner and carrier, and the carrier has a volume specific resistance value within a range from $1.0\times10^{8}$ Ω·cm to $1.0\times10^{10}$ Ω·cm.

This configuration can improve the development efficiency.

(Aspect J)

In an image forming apparatus that includes a latent image bearer such as the photoreceptor 2, a latent image forming unit, such as the exposure device 6, to form a latent image on the latent image bearer, and a developing device to develop the latent image formed on the latent image bearer with toner, the developing device according to any of the above-described aspects A through I is used.

This configuration can inhibit degradation of edge reproducibility while securing the merits of alternating voltage development.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer including two development rollers and disposed to face a latent image bearer; and an alternating voltage circuit configured to apply an alternating voltage to the developer bearer to generate an alternating electrical field in a development range to cause toner to move from the developer bearer to the latent image bearer while reciprocating therebetween, wherein the alternating voltage has a frequency within a range from 10 kHz to 60 kHz and a peak-to-peak voltage of 300 V or greater, a waveform of the alternating voltage includes a non-development portion having a polarity to move toner from the latent image bearer to the developer bearer, a leading end portion of the non-development portion has a greater absolute voltage value than a rest of the non-development portion, wherein only the non-development portion has a leading end of a greater absolute voltage value than the rest of the non-development portion of the waveform of the alternating voltage.

2. The developing device according to claim 1, wherein the waveform of the alternating voltage is a square wave.

3. The developing device according to claim 1, wherein a polarity of the non-development portion is positive.

4. The developing device according to claim 1, wherein the alternating voltage is formed as a composite of an alternating waveform and a direct-current (DC) signal.

5. The developing device according to claim 1, wherein the alternating voltage is applied to both development rollers of the developer bearer.

6. The developing device according to claim 1, wherein the alternating voltage causes toner to reciprocate in an amplitude within a range from 0.3 μm to 30 μm.

7. The developing device according to claim 1, wherein toner has a volume average particle diameter within a range from 4 μm to 7 μm.

8. The developing device according to claim 1, wherein the developer bearer carries two-component developer including toner and carrier, and the carrier has a volume specific resistance value within a range from 1.0×108 Ω·cm to 1.0×1010 Ω·cm.

9. An image forming apparatus comprising:

a latent image bearer;

an exposure device including circuitry to form a latent image on the latent image bearer; and the developing device according to claim 1.

* * * * *